US007282133B2

(12) United States Patent
Burg et al.

(10) Patent No.: US 7,282,133 B2
(45) Date of Patent: Oct. 16, 2007

(54) CERMET INERT ANODE ASSEMBLY HEAT RADIATION SHIELD

(75) Inventors: James T. Burg, Verona, PA (US); LeRoy E. D'Astolfo, Lower Burrell, PA (US)

(73) Assignee: Alcoa Inc., Pittsburgh, PA (US)

( * ) Notice: Subject to any disclaimer, the term of this patent is extended or adjusted under 35 U.S.C. 154(b) by 618 days.

(21) Appl. No.: 10/796,521

(22) Filed: Mar. 8, 2004

(65) Prior Publication Data

US 2005/0194260 A1 Sep. 8, 2005

(51) Int. Cl.
*C25C 3/06* (2006.01)
*C25C 3/12* (2006.01)

(52) U.S. Cl. ..... 205/372; 204/243.1; 204/286.1; 205/386; 205/387

(58) Field of Classification Search ..... 205/372, 205/386, 387; 204/243.1, 286.1
See application file for complete search history.

(56) References Cited

U.S. PATENT DOCUMENTS 4,265,717 A 5/1981 Wiltzius ..... 204/67
4,374,761 A 2/1983 Ray ..... 252/519
5,279,715 A 1/1994 LaCamera et al. ..... 204/64
6,126,799 A 10/2000 Ray et al. ..... 204/291
6,447,667 B1 9/2002 Bates et al. ..... 205/384
6,551,489 B2 4/2003 D'Astolfo, Jr. et al. ..... 205/389
6,783,656 B2 * 8/2004 De Nora et al. ..... 205/381
6,818,106 B2 * 11/2004 D'Astolfo et al. ..... 204/243.1
2003/0127339 A1 7/2003 LaCamera et al. ..... 205/384

* cited by examiner

*Primary Examiner*—Roy King
*Assistant Examiner*—Nicholas A. Smith
(74) *Attorney, Agent, or Firm*—Greenberg Traurig

(57) ABSTRACT

A method of protecting an inert anode assembly (16) operating in an electrolysis cell (10) for producing metal when an adjacent assembly (16') is removed exposing remaining assemblies to low ambient temperatures (40) by utilizing heat radiation shields (24) which can circumscribe every inert anode assembly (16), where the shields (24) remain intact and in place in the cell (10) while operating in molten electrolyte (15) at about 850° C.

12 Claims, 2 Drawing Sheets

CERMET INERT ANODE ASSEMBLY HEAT RADIATION SHIELD

FIELD OF THE INVENTION

The present invention relates to methods for protecting operating inert anode electrodes from temperature drops upon removal and replacement of an adjacent anode. More specifically, the present invention relates to protection of inert anodes and their support structure from thermal shock when operating in a cryolite bath during adjacent anode change out operations.

BACKGROUND OF THE INVENTION

Aluminum is produced conventionally by the electrolysis of alumina dissolved in a cryolite-based molten electrolyte bath at temperatures between about 900° C. and 1000° C.; the process is known as the Hall-Heroult process. A Hall-Heroult reduction cell typically comprises a steel shell having an insulating lining of refractory material, which in turn has a lining of carbon that contact the molten constituents. Conductor bars connected to the negative pole of a direct current source are embedded in the carbon cathode substrate that forms the cell bottom floor. The anodes are at least partially submerged in the cryolite bath.

Electrolytic reduction cells must be heated from room temperature to approximately the desired operating temperature before the production of metal can be initiated. Heating is done gradually and evenly to avoid thermal shock, which can in turn cause breakage or spalling. The heating operation minimizes thermal shock to the lining, the electrodes and the support structure assemblies upon introduction of the electrolyte and molten metal to the cell. Once at operating temperatures carbon anodes erode and have to be replaced usually one at a time, in what is called a "change out" operation. D'Astolfo Jr. et al. in U.S. Pat. No. 6,551,489B2 addressed change out operations where an inert anode assembly containing from about four to eleven inert anodes on a common conducting support was used to replace standard single, large carbon anodes. The inert anodes were about from 12 cm to 76 cm. in diameter and from about 12 cm. to 38 cm. high.

Carbon anodes can be placed in to the electrolyte cold and heated by the energy of the cell to operating temperatures, at which time the nominal current of the anode will be attained. Ceramic anodes have much longer lives but are more prone to thermal shock and therefore need to be preheated in a furnace outside of the electrolytic cell prior to insertion into the hot electrolyte. During transfer, the cooling or heating of the anodes must be also minimized to avoid thermal shock. The thermal shock/cracking was thought to only occur both during movement of the anodes into position and during their placement into the molten salt. Thermal shock relates to the thermal gradient (positive or negative) through the anode that occurs, usually during the movement from the preheat furnace to the cell, and also upon insertion of the anodes into the molten salt. Depending upon the time frame, a thermal gradient as low as between about 20° C. to 50° C. can cause cracking.

In an attempt to protect electrodes in an electrolysis cell from thermal shock during start-up, U.S. Pat. No. 4,265,717 (Wiltzius), taught protection of hollow cylindrical $TiB_2$ cathodes by inserting aluminum alloy plugs into the cathode cavity and further protecting the cathode with a heat dispersing metal jacket having an inside heat insulating layer contacting the $TiB_2$, made of expanded, fibrous kaolin-china clay ($Al_2O_3.2SiO_2.2H_2O$), which would subsequently dissolve in the molten electrolyte. In U.S. Pat. No. 6,447,667 B1 (Bates et al.) the inert anode was coated with carbon and/or aluminum as protection against the cryolite bath. Also, in U.S. Patent Application Publication No. 2003/0127339A1 (LaCamera et al.) anodes were first heated and had an insulating boot attached during submersion into the molten bath. A silica or alumina insulating material was found to be effective. However, such silica or alumina boots were made to dissolve in the bath over time, so that at change out they would usually be non-existent.

Aluminum electrolysis cells have historically employed carbon anodes on a commercial scale. The energy and cost efficiency of aluminum smelting can be significantly reduced with the use of inert, non-consumable, and dimensionally stable anodes. Use of inert anodes rather than traditional carbon anodes allows a highly productive cell design to be utilized, thereby reducing capital costs. Significant environmental benefits are also realized because inert anodes produce essentially no $CO_2$ or $CF_4$ emissions. Some examples of inert anode compositions are provided, for example, in U.S. Pat. Nos. 4,374,761; 5,279,715; and 6,126,799 assigned to Alcoa Inc.

It has recently been found, that, in inert anodes cells, when an anode is replaced by taking it out of an operating bath, at about 960° C., its function as a "heat sink" and radiation shield is lost and the surface temperature of exposed adjacent inert anodes still operating in the molten bath can drop more than 25° C. during the first minute. This could cause adjacent inert anodes to crack and fail in the first 20 seconds. This problem has created a critical need to protect the anodes remaining in the molten bath from temperature drops during change out. It is therefore a main object of this invention to provide some means to protect inert anodes from such temperature drops.

SUMMARY OF THE INVENTION

The present invention is directed to methods for protecting ceramic or cermet inert anodes from thermal shock during operation in an electrolysis cell, when an adjacent anode is replaced by removing the adjacent anode from the cell. The method generally comprises (1) operating an electrolysis cell having a plurality of inert anode assemblies at over 850° C. in a molten cryolite bath, where all of the anode assemblies are shielded by a circumscribed heat radiation shield, (2) withdrawing a shielded anode assembly adjacent to other shielded anode assemblies thus exposing the other shielded assemblies to lower ambient temperatures, and (3) inserting a new shielded anode assembly adjacent the other shielded anode assemblies, wherein the radiation shield does not disintegrate in contact with cryolite fumes, remains intact and in place above the molten bath, and prevents a temperature drop within its circumscribed assembly of under about 30° C. Preferably the shield prevents a temperature drop of under about 20° C. The heat radiation shield is in place during submersion of the anode into the molten bath and during its operation in the cell. The bath preferably comprises cryolite. Because the inert anodes can be rapidly cracked at short temperature gradients during operation of the cell, the effect of temperature gradients must be minimized. The change to a new shielded assembly is preferably accomplished in less than 60 seconds, most preferably 10 seconds to 50 seconds.

Similarly, the castable box or plate which is positioned just above the anodes are also subject to thermal shock. The plates, typically made of a refractory material such as a silica or alumina ceramic, can also crack as a result of thermal gradients. Accordingly, the present invention is further directed to an optional method for protecting castable plates from thermal shock by extending the heat radiation shield to the plates.

The present invention further provides a method of replacing anode assemblies which are immersed in a bath comprising molten electrolyte in an aluminum electrolysis cell comprising: (1) operating an aluminum electrolysis cell at a temperature over about 850° C., where a plurality of adjacent anode assemblies are immersed in molten electrolyte, said assemblies being subject to deterioration by at least the electrolyte and also operating as a heat sink and radiation shield while in the molten electrolyte, where all of the anode assembly comprises an inert shielded anode having an attached, heat radiation shield; (2) removing at least one anode assembly adjacent another shielded assembly by drawing it out of the molten electrolyte, thus exposing the remaining adjacent shielded assemblies to lower external ambient temperatures, wherein the heat radiation shield reduces radiative cooling of the shielded inert anode assembly over about 30° C.; and (3) replacing the removed anode assembly with another anode assembly, wherein the heat radiation shield remains intact and in place above the molten electrolyte bath. In order to assist the function of the heat radiation shield, the anode removal and replacement process should be completed in less than about 3 minutes. The heat radiation shields are from about 0.2 cm to about 4.0 cm thick and preferably are made of ceramic selected from at least one of alumina or silica. Unlike the previous protective boots previously described as taught in U.S. Patent Application Publication No. 2003/0127339A1 by LaCamera et al., these heat radiation shields are designed with materials that are capable of surviving in severe environments that exist just above the bath. In addition to surviving, they must also provide the thermal protection required to prevent anode thermal shock. Preferred materials include alumina and at least one of silica and calcia, which is meant to herein include materials such as, high alumina materials, aluminates including alumina silicates, calcium aluminates and calcium alumina silicates. Preferably, they consist essentially of those materials.

DETAILED DESCRIPTION OF PREFERRED EMBODIMENTS

The present invention is directed to a method for protecting an inert anodes from thermal shock. Preferably, the inert anode is made of a cermet or ceramic material. The present invention is further directed to a method for protecting a castable support for the anode from thermal shock.

Figure 1:
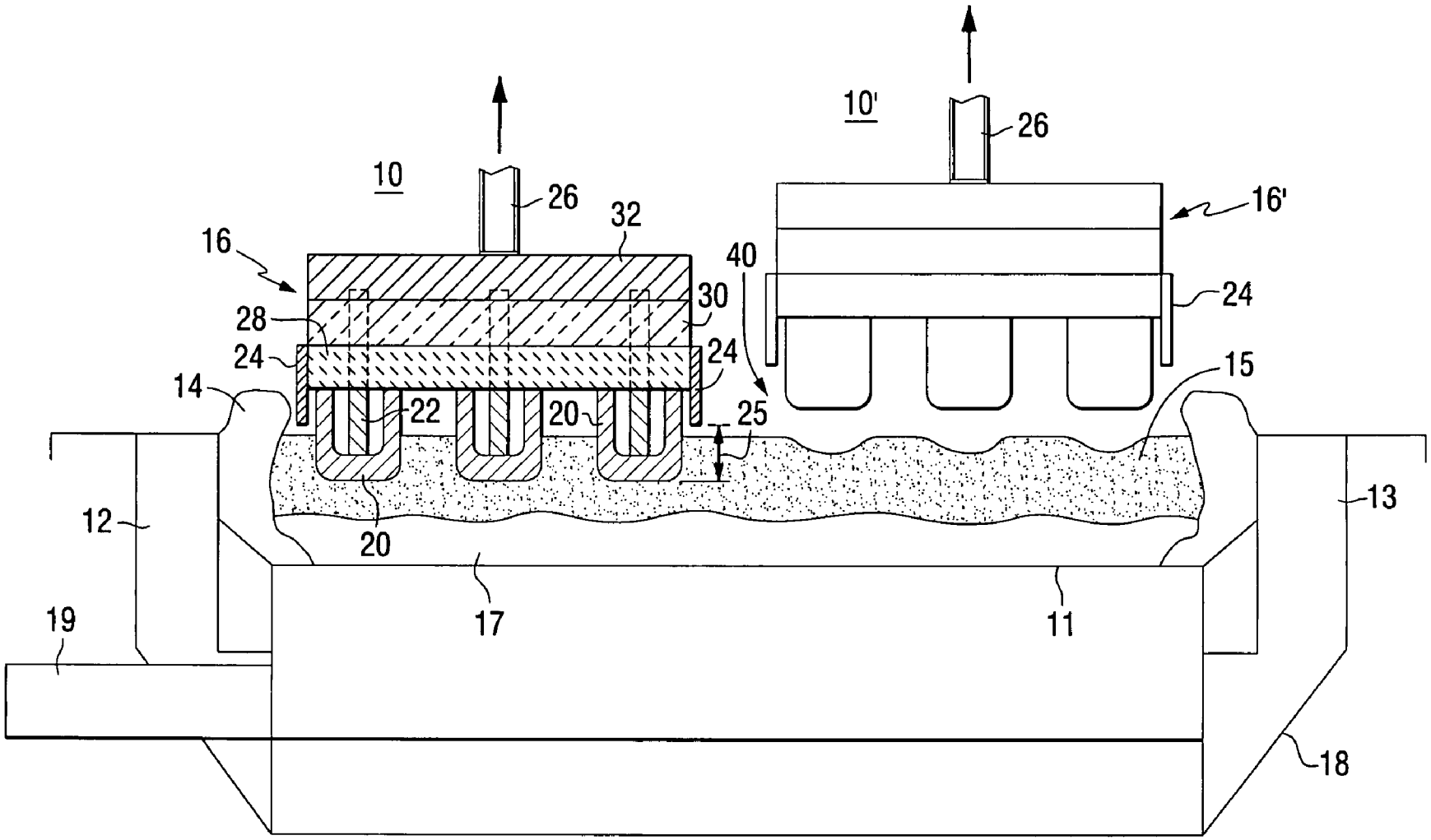
FIG. 1 is a schematic illustration, partly in section, showing replacement of an anode assembly 16' in an electrolysis cell for making aluminum utilizing a molten electrolyte, with a still immersed adjacent anode assembly 16, both having an attached heat radiation shield.

Referring now to FIG. 1, one type of operating electrolytic cell 10 for producing metal, such as aluminum is shown, and can include a carbon cathode floor 11 and sidewalls 12, 13 extending upwardly from the floor 11. The cell 10 will initially be described as the in place anode assembly 16, shown as the left assembly in FIG. 1. The sidewalls 12, 13 can be both covered by a solid crust 14. The floor 11 and sidewalls 12, 13 define a chamber above the molten cryolite bath 15 and aluminum deposit 17. A steel shell 18 supports the floor 11 and sidewalls 12, 13. A metal collector bar 19 carries current from the carbon cathode floor 11. The cell 10 includes several anodes 20 fastened by electrically conductive metal conductors 22 which can pass through a protective ceramic cover 28 and a layer of insulation 30. The conductors 22 are attached to a metallic distribution plate 32. The distribution plate is supported by a support beam 26 which can be used to raise or lower the anode assembly 16. The conductors 22, distribution plate 32, and support beam 26 together make up a support structure assembly for the anodes 20 and anode assembly 16. The ceramic cover 28 and insulation layer provide environmental and thermal protection.

The conductors 22 are made of any suitable material providing electrical conductivity to the anodes 20. The insulating layer 30 preferably includes one or more thermal insulating layers of any suitable composition. The protective cover 28 is made from a highly corrosion resistant ceramic material capable of being exposed to the severe environment above the molten bath 15. An electrically conductive metallic distribution plate 32 provides a current path between the support beam 26 and the conductors 22.

The inert anodes 20 are protected from thermal shock during removal of an adjacent anode assembly 16' by heat radiation shields 24. The radiation shields preferably can be disposed a distance 25 above the bottom of the inert anode 20 as shown. The shields circumscribe at least two sides of the assembly and preferably, while not shown, surround the assembly and inert anodes 20 on all four sides. The distance 25 can range from 12 cm to 20 cm. The ambient atmosphere 40, is substantially cooler than the molten cryolite 15 by at least 800° C. As the anode assembly 16' is removed, a major heat sink and radiation shield is lost and adjacent inert anodes are exposed to the ambient atmosphere 40 which can cause cooling of over 20° C. A change about 20° C. to 30° C. can provide sufficient thermal stress to initiate cracking of ceramic or cermet inert anodes.

Figure 2:
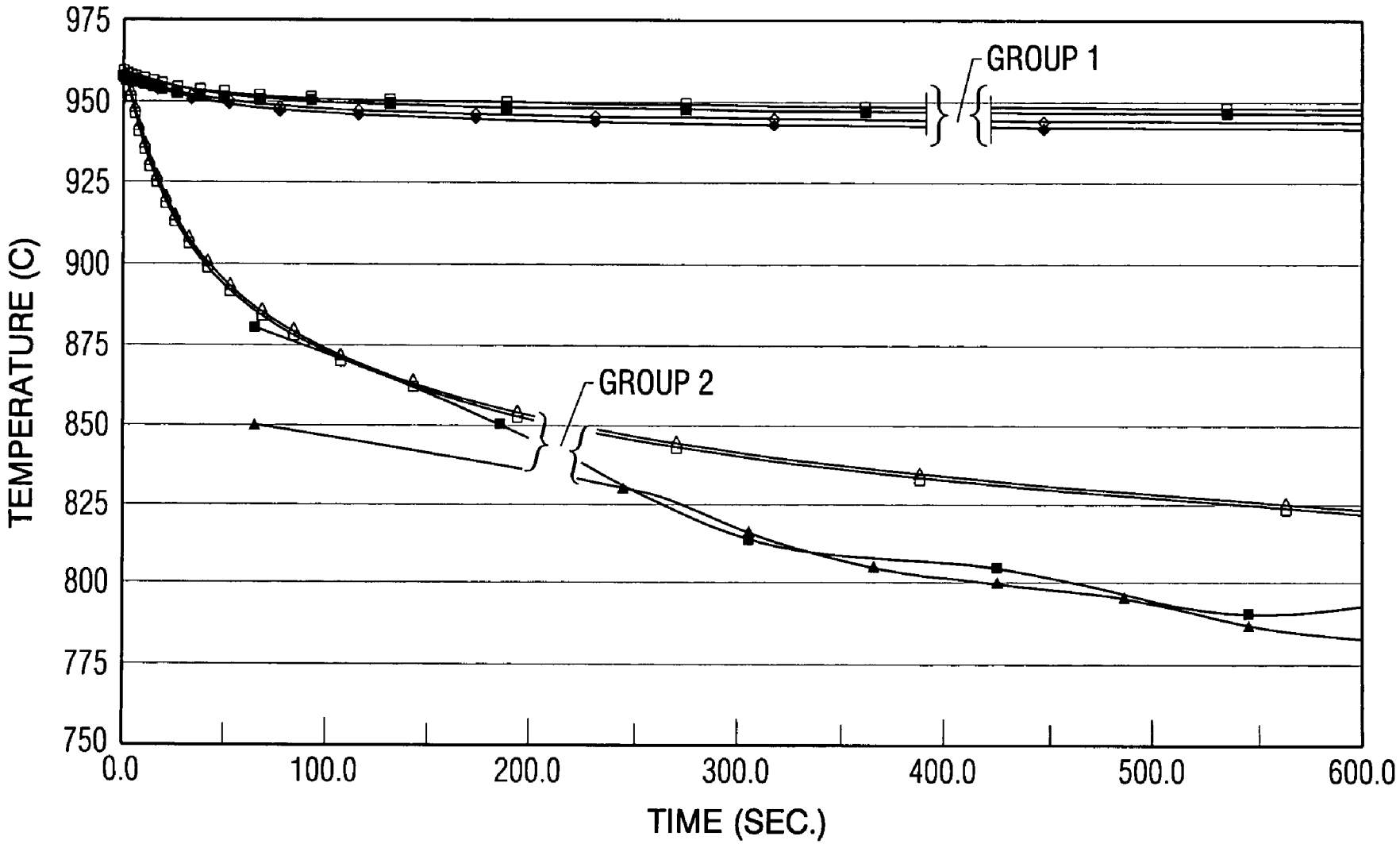
FIG. 2 is a graph of temperature drop of the anode vs. time, for anodes with radiation shields (Group 1) and without radiation shields (Group 2), as determined from both thermal measurements and simulations of anode assembly charge out processes.

FIG. 2 illustrates a simulation of the change in anode surface temperature over time during change out, where series of curves shown as Group 2, show surface temperature changes without a radiation shield in ° C. vs. Group 1 with a radiation shield in ° C. As can be seen, Group 1 which includes shields made of a high alumina material having a thickness of 0.30 cm provided sufficient radiation protection from the ambient temperatures to limit the temperature change to about 20° C. to 30° C. Because the radiation shields must remain intact above the bath in order to protect the anodes from thermal shock, they must not dissolve in molten cryolite fumes.

The requirements for non-dissolvable, effective radiation shields which surround/circumscribe an anode assembly or plate to which the anode is attached in terms of ratio of shield compositions, porosity, thickness, thermal shock and the like are now described in detail. An effective radiation shield material must be resistant to chemical attack from fluoride fumes and occasional splashing of cryolite bath. It must also be able to withstand thermal shock encountered during anode insertion and movements of adjacent anodes. Simple or compound oxides of alumina with silica and calcia have been found to be both chemically and thermal shock resistant. Alumina content should be from 50 wt % to 95 wt % or more preferably 60 wt % to 85 wt %. Porosity must be low enough to afford good mechanical strength, but not so low as to negatively impact thermal shock resistance. Porosity should be in the range of 5 vol % to 30 vol %, or more preferably 10 vol %-25 vol %.

Thickness requirements are determined by strength and practical fabrication limitations. The minimum practical thickness which satisfies mechanical integrity and ease of fabrication should be used that is and from 0.3 cm to 4.0 cm is preferably in the range of 1.27 cm to 3.7 cm or more preferably 1.9 cm to 3.18.

Having described the presently preferred embodiments, it is to be understood that the invention may be otherwise embodied within the scope of the appended claims.

What is claimed is:

1. A method of protecting inert anode assemblies from thermal shock during operation in a metal producing cell comprising:

(1) operating an electrolysis cell having a plurality of inert anode assemblies at over 850° C. in a molten cryolite bath, where all of the anode assemblies are shielded by a circumscribed heat radiation shield that is attached to the inert anode assembly, and wherein the heat radiation shield is spaced from the anodes of the inert anode assembly;

(2) withdrawing a shielded anode assembly adjacent to other shielded assemblies thus exposing the other assemblies to lower ambient temperatures; and (3) inserting a new shielded anode assembly adjacent the other shielded anode assemblies;

wherein the heat radiation shield does not disintegrate in contact with cryolite fumes, remains intact in place above the molten bath, and prevents a temperature drop within its circumscribed assembly of under about 30° C.

2. The method of claim 1, wherein the heat radiation shield is from about 0.2 cm to 4.0 cm thick and comprises alumina and a material selected from the group consisting of silica, calcia, and mixtures thereof, wherein the alumina content is from 50 wt % to 95 wt %.

3. The method of claim 1, wherein the anode assembly is withdrawn from the cell and a new shielded replacement assembly is installed in less than 60 seconds.

4. The method of claim 1, wherein the radiation shield prevents a temperature drop within its circumscribed assembly of under about 20° C.

5. The method of claim 1, wherein a new shielded assembly is installed in from 10 seconds to 50 seconds.

6. The method of claim 2, wherein the alumina content is from 60 wt % to 85 wt % and the porosity of the shield is from 5 vol % to 30 vol %.

7. A method of replacing anode assemblies which are immersed in a bath comprising molten electrolyte in an aluminum electrolysis cell comprising:

(1) operating an aluminum electrolysis cell at a temperature over about 850° C., where a plurality of adjacent anode assemblies are immersed in molten electrolyte, said assemblies being subject to deterioration by at least the electrode and also operating as a heat sink while in the molten electrolyte, where all of the anode assembly comprises an inert shielded anode having an attached, heat radiation shield and act as a radiation shield;

(2) removing at least one anode assembly adjacent another shielded assembly by drawing it out of the molten electrolyte, thus exposing the remaining adjacent shielded anodes to lower radiative external ambient temperatures, wherein the heat radiation shield reduces cooling of the shielded inert anode assembly over about 30° C.; and (3) replacing the removed anode assembly with another anode assembly, wherein the heat radiation shield remains intact and in place above the molten electrolyte bath.

8. The method of claim 7, wherein the heat radiation shield is from about 0.2 cm to 4.0 cm thick and consists essentially of alumina and a material selected from the group consisting of alumina, silica, calcia and mixtures thereof, wherein the alumina content is from 50 wt % to 90 wt %.

9. The method of claim 7, wherein the anode assembly is withdrawn from the cell and a new shielded replacement assembly is installed in less than 60 seconds.

10. The method of claim 7, wherein the shield reduces radiative cooling over about 20° C.

11. The method of claim 7, wherein the anode assembly is withdrawn from the cell and a new shielded assembly is installed in from 10 seconds to 50 seconds.

12. The method of claim 7, wherein the molten bath comprises cryolite, where alumina content is from 60 wt % to 80 wt % and the porosity of the shield is from 5 vol % to 30 vol %.

* * * * *